United States Patent [19]

Hansell, III

[11] 4,419,538

[45] Dec. 6, 1983

[54] UNDER-CARPET COAXIAL CABLE

[75] Inventor: George A. Hansell, III, Newark, Del.

[73] Assignee: W. L. Gore & Associates, Inc., Newark, Del.

[21] Appl. No.: 321,104

[22] Filed: Nov. 13, 1981

[51] Int. Cl.[3] ..... H01B 7/08

[52] U.S. Cl. ..... 174/117 F; 174/115; 174/117 R

[58] Field of Search ..... 174/70 C, 72 C, 115, 174/117 R, 117 F

[56] References Cited

U.S. PATENT DOCUMENTS

| | | | |
|---|---|---|---|
| 2,950,338 | 8/1960 | Taylor | 174/117 F |
| 3,033,916 | 5/1962 | Scofield | 174/117 R |
| 3,060,260 | 10/1962 | Scofield | 174/117 F |
| 4,220,807 | 9/1980 | Anastasi et al. | 174/117 F X |
| 4,220,812 | 9/1980 | Ney et al. | 174/117 F |
| 4,250,351 | 2/1981 | Bridges | 174/115 X |
| 4,314,737 | 2/1982 | Bogese | 174/117 F |

FOREIGN PATENT DOCUMENTS

| | | | |
|---|---|---|---|
| 670831 | 10/1964 | Italy | 174/115 |

OTHER PUBLICATIONS

Schuh, A. G.; Flat Flexible Cable and Wiring–Types, Materials, Constructions, and Features; Insulation/Circuits; Oct. 1970, pp. 27–34.

Gerpheide, B. A.; Selection of Insulation Systems for Flexible Flat Conductor Cables and Circuits; Insulation; Dec. 1969; pp. 27–33.

*Primary Examiner*—J. V. Truhe

*Assistant Examiner*—Morris H. Nimmo

*Attorney, Agent, or Firm*—Finnegan, Henderson, Farabow, Garrett & Dunner

[57] ABSTRACT

A thin-profile electrical cable is rendered capable of enduring compressive and tensile loading encountered in under-carpet usage by encasing separately in the same flat pliable jacket the conductor to be protected and parallel to it one or more hard cable-like stress-carrying elements which are afforded free slippage within the jacket in the direction of their lengths. The jacket surface is scored by parallel grooves in the vicinity of the embedded conductor to cause compressive loads to be borne by the stress-carrying elements.

9 Claims, 4 Drawing Figures

UNDER-CARPET COAXIAL CABLE

BACKGROUND OF THE INVENTION (a) Field of the Invention

This invention relates to electrical cables, and more particularly, to coaxial electrical cables, for use where space is limited or where a thin flat cable cross section is preferred and where the cable is likely to be exposed to mechanical loads, either tensile or compressive. Typically, coaxial cables embodying this invention are envisioned for use under floor carpeting in areas where furniture is to be placed or where human or equipment traffic is anticipated.

(b) Background Art

Modern concepts in building construction have spurred a search for sturdy under-carpet cabling of all types. In response to the development of a format for safely installing electrical power wiring between floors and carpets, national electrical codes have been revised to permit electrical conductors to be located under carpets. However, until the advent of this invention, the particular requirements of the wiring needed to interconnect a significant class of office equipment had not been met with regard to under-carpet deployment.

Modern office operations are increasingly reliant for the performance of their accounting, library, and word processing functions upon the information handling and storage capacities of large central computers. To maximize the flexibility and potential of such costly machinery, multiple access is afforded to these computers through a system of peripheral individual terminals, each interconnected to the main computer by electrical cables. The preservation of the integrity of the information passing as electrical impulses upon such cables is a crucial requisite for the successful operation of such an extended system. This high fidelity transmission has been achieved in the past by making the interconnecting cables sufficiently sturdy to preserve their uniform impedance characteristics and by providing the conductor with coaxial shielding from external electromagnetic interference.

When an attempt is made, in conformity with current construction trends, to lay such cables under carpets, several difficulties arise. First, coaxial cables are generally of sufficient size that they will not permit a carpet covering them to lie flat. When previously produced in a small size, these cables, though fitting inconspicuously between carpet and floor, have been vulnerable to damage from mechanical stress applied to them due to bends in routing or to the ordinary use of the floor area that they serve. Loads set upon or traffic traveling over these thin cables tend to compress their cross section, while the twisting and bending required by their routing and subsequent movement of their ends or the floor covering produce tensile forces that also endanger their structural integrity.

Two types of resulting structural damage are common. First, deformation of either the dielectric surrounding the conductor core or of the coaxial shield enclosing the dielectric can change the electrical impedance characteristics in the area so affected. Such local distortions, even if temporary, can alter electrical signals then passing through the cable. Surprisingly, temporary deformation, as for instance, due to traffic on the carpet over the signal carrier, may be more troublesome in a computer system than is permanent damage to a cable. The irregularity of the loss of fidelity that occurs in a coaxial cable being subjected to intermittent temporary deformations may alert users that the system is unreliable without permitting a conclusive determination of the cause of the problem.

A second form of damage which mechanical loading can cause in under-carpet coaxial cables is the separation of either the coaxial shield or the conductive signal-carrying core. This will result in no transmission if the broken portions do not again contact each other. However, it is common that the broken parts do reengage one another, establishing erratic transmission, the cause of which is difficult to locate.

It is one object of the present invention to produce a flat coaxial cable thin enough to be installed beneath a carpet under current and proposed national electrical wiring codes.

A second object is to afford to such a cable sufficient flexibility within its transverse plane as to permit its easy routing and to insure that any such routing does not alter the electrical characteristics of the conductor.

A final objective of the present invention is to protect miniaturized conductors beneath carpets from damage due to compressive loads upon the installed cable.

SUMMARY OF THE INVENTION

This invention comprises a cable having a typical thickness of about about 0.080 inch in which one or more elongated electrical signal conductors, which can be coaxial cables, are enclosed by a flat, pliable, electrically insulative jacket. The conductors are protected by hard elongated stress-bearing members separately embedded in the jacket parallel to the conductors. The jacket serves as a means for fixing the transverse relationship of the conductors and the stress-bearing members, and for permitting the stress-bearing members to move independently along their own lengths. The jacket is further provided on its surface around the elongated conductors with relief shaping means in the form of a plurality of longitudinal channels, which insure that stress-bearing members receive the brunt of any compressive load imposed upon the installed assemblage.

BRIEF DESCRIPTION OF THE DRAWINGS

Further details of the invention are explained below with the help of the examples illustrated in the attached drawings, in which.

DESCRIPTION OF THE PREFERRED EMBODIMENT

Figure 1:
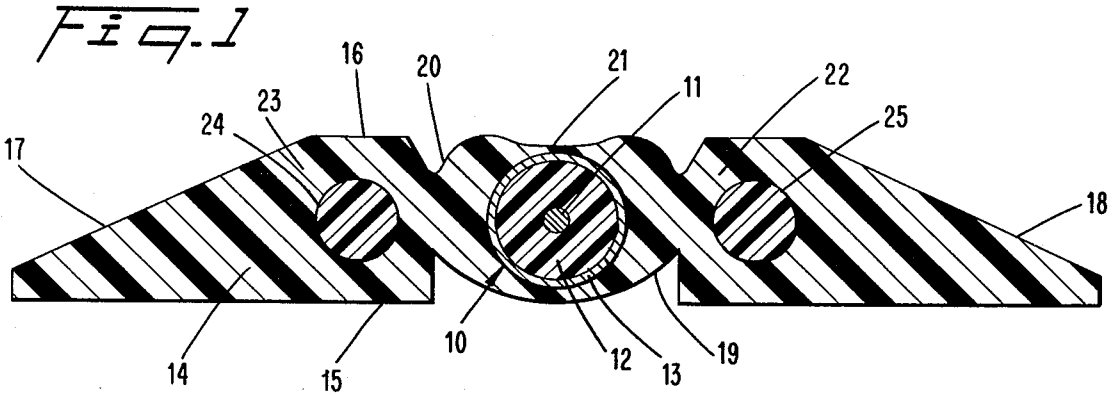
FIG. 1 is an end view of a cable embodying the invention and containing a single coaxial conductor.

Referring to FIG. 1, an end view of a preferred embodiment of the invention is shown. Although the current invention may prove advantageous in protecting any type of signal conductor, including a pair of twisted primary carriers, FIG. 1 depicts an under-carpet cable having a signal carrier 10, which is a coaxial cable. Such a signal conductor typically consists of an electrically conductive core 11 surrounded by a layer of dielectric 12, which is itself in turn enclosed in an electrically conductive shield 13. It is the purpose of shield 13 to prevent any externally originating electromagnetic signals from inducing in conductive core 11 electrical impulses which would degrade the fidelity of electrical transmissions thereon. Any number of materials and constructions known in the prior art are effectively employable as coaxial shield 13. The same is true as to dielectric 12; however, in this capacity expanded polytetrafluorethylene, such as disclosed in U.S. Pat. No. 3,953,566, is felt to have a superior suitability in that its remarkably low dielectric constant permits the use of a conductive core 11 having a larger cross-sectional area than would otherwise be possible.

Signal conductor 10 is encased in a pliable electrically insulative jacket 14 having a generally trapezoidal cross section. As shown, jacket 14 has a wide base 15 and a top surface 16 parallel thereto. The separation between base 15 and top 16 surface constitutes the thickness of the cable. Sloping surfaces 17,18 taper this thickness toward the outer edges of the cable. When the cable is installed beneath a carpet, base 15 rests upon the floor and top surface 16 supports the carpet. Therefore, it is desirable to minimize the thickness of the cable in order to permit placement of the cable beneath a carpet without significantly disturbing the flatness thereof. However, cable thickness can only be minimized within certain limits. As the cable is made thinner, so too must the diameter of signal conductor 10 be reduced with the cross-sectional area of its conductive core 11 diminishing accordingly. Beyond a certain point this miniaturization of signal conductor 10 results in an unacceptable increase in the electrical resistance of conductive core 11. A cable thickness on the order of 0.080 inches has been found to be a workable compromise between such competing constraints.

Both base 15 and top surface 16 of jacket 14 are scored in the vicinity of signal conductor 10 by a plurality of parallel longitudinal channels 19, 20, 21, which may take a number of forms ranging from shallow depressions to steep-sided slots. This relief shaping serves as a means of protecting signal conductor 10 from the brunt of any compressive stress applied to the cable through the placement of objects upon or the passage of traffic over the carpet beneath which the cable is installed. When a compressive force is applied to the cable, channels 19, 20, 21, afford open spaces into which jacket 14 in the vicinity of signal carrier 10 may deform, thus preventing compression of signal carrier 10. This capacity for elastic deformation in the vicinity of signal carrier 10 does not exist at solid portions 22, 23 of jacket 14 located to either side of signal carrier 10. Therefore, solid portions 22,23 will tend to carry the compressive loads applied to the cable, producing a bridge effect and affording additional protection to the physical integrity of signal conductor 10.

A cable thickness greater in the vicinity of signal conductor 10 than at solid portions 22,23 will tend to defeat the desirable consequences of both the bridge effect and the relief shaping, while in the contrary instance enchanced consequences will result. Significant thinning of the cable in the vicinity of signal carrier 10, however, requires corresponding reductions in the diameter of signal carrier 10 and in the cross-sectional area of conductive core 11. This in turn raises the problem of unacceptable increases in the electrical resistance of conductor core 11 mentioned above. Therefore, the cable thickness in the vicinity of signal carrier 10 should be equal to or slightly less than it is at solid portions 22,23.

To enhance the capacity of the cable to support compressive loads, a hard stress-bearing member 25 is embedded in solid portion 22 of jacket 14 longitudinally disposed parallel to and spaced apart from signal conductor 10. Similarly a hard stress-bearing member 24 is embedded within solid portion 23 of jacket 14. In combination with stress relief channels 19,20,21 on the surface of jacket 14 near signal conductor 10, stress-bearing members 24,25 permit the cable to be subjected to substantial compressive loading without the risk of distorting signal conductor 10.

While stress-bearing members 24,25 add rigidity to the cable structure enabling it to more effectively endure compressive stress, members 24,25 could pose difficulties in cables not constructed in accordance with the present invention. The stiffness of members 24,25 would ordinarily render the cable more difficult to bend to the left or the right in its transverse plane, as shown respectively in FIGS. **2*b* and 2*c*, which are top views of the preferred embodiment of FIG. 1. Such transverse bending is normally required in cable routing. At any such bend, inner and outer cable edges, as well as the stress-bearing members embedded in them, have respectively shorter and longer paths around the bend. The stress-bearing members on the inside of the bend tend to be forced laterally outward and stress-bearing members on the outside of the bend tend to be drawn laterally inward, compressing between the two members the central portion of jacket 14 which encloses signal conductor 10. This compression can distort the structure of signal conductor 10 as well as reduce the flexibility of jacket 14 in its vicinity, rendering signal conductor 10** additionally susceptible to compression damage where transverse bending of the cable exits.

A significant purpose of this invention is directed toward overcoming these difficulties. Pliable jacket 14, while being a means for fixing the transverse relationship of signal conductor 10 with stress-bearing members 24,25, additionally serves as a means for permitting the independent longitudinal movement of stress-bearing members 24,25 relative to jacket 14, thereby allowing the incorporation of stress-bearing members 24,25 into the cable structure so that their rigidity can contribute to the protection of signal conductor 10 without making cable routing difficult to accomplish or dangerous to signal conductor 10.

Figure 2B:
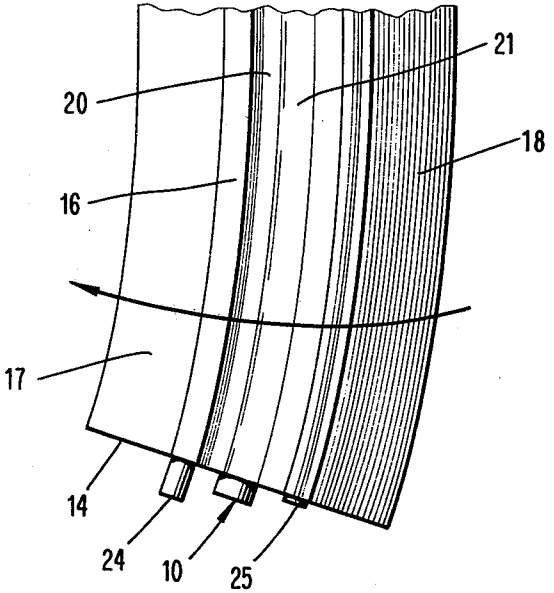
FIG. 2*b* is a top view of the end section of the invention shown in FIG. 2*a*, bent to one side, as in routing, and exhibiting the resulting displacement of its internal parts.
Figure 2C:
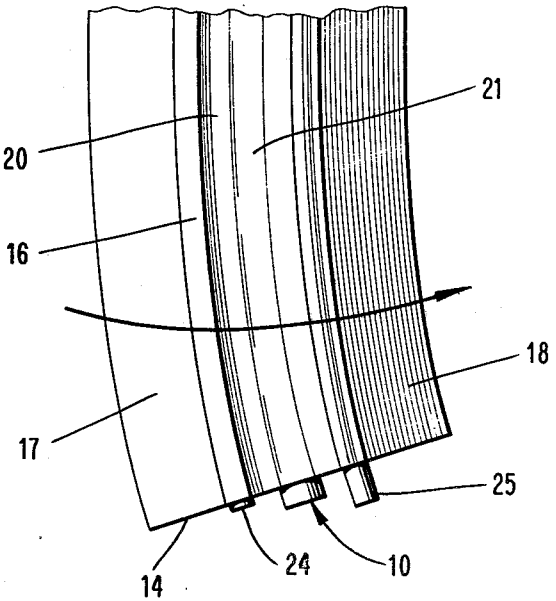
FIG. 2*c* is a top view of the end section of the invention shown in FIG. 2*a*, bent, as in routing, in the direction opposite from that shown in FIG. 2*b*.
Figure 2A:
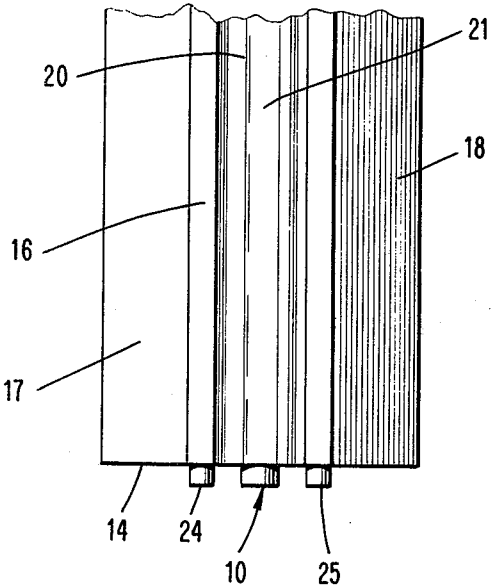
FIG. 2*a* is a top view of an end section of the invention shown in FIG. 1.

FIGS. **2*a*, 2*b* and 2*c* illustrate how this capacity for independent longitudinal movement in stress-bearing members 23,24 eliminates cable routing difficulties. In FIG. 2*a*, a top view of the preferred embodiment of FIG. 1 is shown in which signal conductor 10 and stress-relief members 24,25 extend a small distance beyond the end of jacket 14. In FIG. 2*b* the same segment of the cable as depicted in FIG. 2*a* has been bent toward tapering edge 17. This bending compresses the transverse half of jacket 14 containing solid portion 23 while it stetches the other transverse half of jacket 14, which includes solid portion 22. Being free to move longitudinally within jacket 14, stress-bearing members 24,25 are neither compressed nor stretched in the process, but retain their original lengths. As solid portion 23 surrounding stress-bearing member 24 is compressed while stress-bearing member 24 embedded therein is not, the end of stress-bearing member 24 emerges slightly from jacket 14. As solid portion 22 surrounding stress-bearing member 24 is stretched while stress-bearing member 25 embedded therein is not, the end of stress-bearing member 25 withdraws slightly into jacket 14. If the stress-bearing members 24,25 adhered to jacket 14, they would resist any bending of the cable and in areas of bending would tend to compress between them the central portion of jacket 14 containing signal conductor 10**. FIG. 2*c* depicts the reversed effects of bending the cable of FIG. 2*a* toward tapering edge 18. Stress-bearing member 25 is seen to emerge further from jacket 14 while stress-bearing member 24 recedes into jacket 14.

An additional implication of this freedom of longitudinal movement in stress-bearing members 24,25 is that any tension applied to the ends of members 24,25 is not transmitted to jacket 14 or in turn to conductor 10.

Although independent freedom of longitudinal movement within jacket 14 can be afforded to stress-bearing members 24,25 in many ways, it has been discovered that a simple and effective method of doing so is to employ in conjunction with a jacket 14 of flexible polyvinylchloride, stress-bearing members 24,25 composed of solid nylon. Nylon is hard enough to withstand compression, yet possessed of a sufficiently slick outer surface as to permit it to slide within a jacket 14 made of polyvinylchloride. Other combinations of materials for stress-bearing members 24,25 and jacket 14 may achieve the same effect and could be easily determined by one of ordinary skill given the teaching of the present disclosure. Such other combinations are thus considered to fall within the scope of the present invention.

While what has been described and shown is a particular embodiment of the invention, it should be understood that many modifications may be made upon it without departing from the spirit of the invention. It is possible, for example, to encase in a single flexible jacket a plurality of signal conductors, either adjacent to each other or interspersed among an appropriate array of stress-bearing members. The relief shaping may take a form other than a series of parallel grooves, or the elements of the cable can be made of a variety of materials and have cross sections differing from those shown. Therefore, the appended claims should be considered as embracing all such modifications as may rightfully fall within the scope of this invention.

What is claimed is:

1. A thin, flat electrical cable of the type having opposing generally flattened surfaces, the cable comprising:

(a) at least one elongated signal conductor;

(b) at least two elongated stress-bearing members longitudinally disposed parallel to, spaced apart from, and on opposite sides of, said signal conductor, said two members for bearing stresses resulting from a compressive load applied against the cable opposing surfaces; and (c) a unitary, electrically insulative, pliable jacket means for fixing the transverse relationship of said signal conductor and said stress-bearing members, said means also for affording independent longitudinal movement to said stress-bearing members relative to said jacket means, said jacket means separately enclosing said signal conductor and said stress-bearing members.

2. An electrical cable, as recited in claim 1 wherein said signal conductor is a coaxial cable.

3. A thin, flat electrical cable, as recited in claim 1, further including (d) relief shaping means around said signal conductor on the surface of said pliable jacket for diverting away from said signal conductor toward said stress-bearing members a major portion of stresses resulting from a compressive load applied against the cable opening surface.

4. An electrical cable, as recited in claim 3, wherein said relief shaping means is in the form of a plurality of parallel longitudinal channels.

5. An electrical cable, as recited in claim 3 or claim 4, wherein said signal conductor is a coaxial cable.

6. A thin, flat electrical cable for installation between a relatively unyielding floor surface and a relatively yielding floor covering, the cable comprising:

(a) a coaxial cable;

(b) two stress-bearing members having circular cross sections and being longitudinally disposed parallel to and on opposite sides of said coaxial cable in a spaced-apart relationship therewith;

(c) unitary, electrically insulative, pliable jacket means of generally trapezoidal cross section for fixing the transverse relationship among said and said coaxial cable stress-bearing members, said means also for affording independent longitudinal movement to said stress-bearing members relative to said jacket means, said jacket means separately enclosing said coaxial cable and said stress-bearing members; and (d) relief shaping means in the form of a plurality of parallel longitudinal channels around said coaxial cable on the surface of said pliable jacket for diverting away from said coaxial cable toward said stress-bearing members a major portion of any vertically compressive load applied to said thin, flat cable as installed.

7. An electrical cable, as recited in any one of claim 1, claim 3, claim 5, or claim 6, wherein:

(a) said jacket means is composed of flexible polyvinylchloride; and (b) said stress-bearing members are composed of solid nylon.

8. An electrical cable, as recited in claim 7, wherein said coaxial cable contains a dielectric composed of expanded polytetrafluoroethylene.

9. An electrical cable as recited in claim 8 having a thickness of about 0.080 inch.

* * * * *

UNITED STATES PATENT AND TRADEMARK OFFICE

CERTIFICATE OF CORRECTION

PATENT NO. : 4,419,538

DATED : December 6, 1983

INVENTOR(S) : George A Hansell, III

It is certified that error appears in the above—identified patent and that said Letters Patent is hereby corrected as shown below:

In claim 6, lines 11-12, change "among said and said coaxial cable stress-bearing members" to --among said coaxial cable and said stress-bearing members--.

In claim 3, line 3, delete "(d)" and line 8, change "opening" to -- opposing --.

Signed and Sealed this

*Fifth* Day of *June 1984*

[SEAL]

*Attest:*

GERALD J. MOSSINGHOFF

*Attesting Officer*

*Commissioner of Patents and Trademarks*